US006621074B1

(12) United States Patent
Vestal

(10) Patent No.: US 6,621,074 B1
(45) Date of Patent: Sep. 16, 2003

(54) TANDEM TIME-OF-FLIGHT MASS SPECTROMETER WITH IMPROVED PERFORMANCE FOR DETERMINING MOLECULAR STRUCTURE

(75) Inventor: Marvin L. Vestal, Framingham, MA (US)

(73) Assignee: PerSeptive Biosystems, Inc., Framingham, MA (US)

( * ) Notice: Subject to any disclaimer, the term of this patent is extended or adjusted under 35 U.S.C. 154(b) by 0 days.

(21) Appl. No.: 10/198,372

(22) Filed: Jul. 18, 2002

(51) Int. Cl.[7] ..... H01J 49/16
(52) U.S. Cl. ..... 250/287; 250/282
(58) Field of Search ..... 250/282, 287

(56) References Cited

U.S. PATENT DOCUMENTS 6,204,500 B1 * 3/2001 Whitehouse et al. ..... 250/287
2002/0024010 A1 * 2/2002 Hager ..... 250/282

* cited by examiner

*Primary Examiner*—John R. Lee
*Assistant Examiner*—Phillip Johnston
(74) *Attorney, Agent, or Firm*—Andrew T. Karnakis

(57) ABSTRACT

A tandem time-of-flight mass spectrometer is described. The tandem time-of-flight mass spectrometer includes a pulsed ion source that generates a plurality of ions. A first time-of-flight mass separator accelerates the plurality of ions, fragments at least a portion of the accelerated plurality of ions, and then selects a first group of ions and fragments thereof. A second time-of-flight mass separator accelerates the first group of ions and fragments thereof, fragments at least a portion of the accelerated first group of ions and fragments thereof, and then selects a second group of ions and fragments thereof. A third time-of-flight mass separator accelerates the second group of ions and fragments thereof. An ion detector detects the second group of ions and fragments thereof from the third time-of-flight mass separator.

29 Claims, 6 Drawing Sheets

TANDEM TIME-OF-FLIGHT MASS SPECTROMETER WITH IMPROVED PERFORMANCE FOR DETERMINING MOLECULAR STRUCTURE

FIELD OF THE INVENTION

This invention relates generally to mass spectrometers and to methods of performing mass spectroscopy. In particular, this invention relates to tandem time-of-flight mass spectrometers and to methods of performing mass spectroscopy using tandem time-of-flight mass spectrometers.

BACKGROUND OF THE INVENTION

Mass spectrometers vaporize and ionize a sample of interest and determine the mass-to-charge ratio of the resulting ions. Time-of-flight (TOF) mass spectrometers determine the mass-to-charge ratio of an ion by measuring the amount of time it takes a given ion to migrate from an ion source to a detector, under the influence of electric fields. The time it takes for an ion to reach the detector, for electric fields of given field strengths, is a direct function of the ion's mass and an inverse function of the ion's charge.

Recently, TOF mass spectrometers have become widely accepted, particularly for the analysis of relatively nonvolatile biomolecules, and for other applications requiring high speed, high sensitivity, and/or wide mass range. New ionization techniques such as matrix-assisted laser desorption/ionization (MALDI) and electrospray (ESI) have greatly extended the mass range of molecules that can be analyzed by mass spectrometers. These techniques can produce intact molecular ions in a gas phase suitable for analysis.

TOF mass spectrometers have unique advantages for these applications. The recent development of delayed ion extraction, for example, as described in U.S. Pat. Nos. 5,625,184, 5,627,369, and 6,057,543 has made high resolution and precise mass measurement routinely available with MALDI-TOF mass spectrometers. The entire disclosures of U.S. Pat. Nos. 5,625,184, 5,627,369, and 6,057,543 are incorporated herein by reference. Orthogonal injection with pulsed extraction has provided similar performance enhancements for ESI-TOF. These techniques provide accurate data on the molecular weight of samples. However, these techniques provide little information on molecular structure.

Some prior art MALDI-TOF mass spectrometers use a technique known as post-source decay (PSD) to fragment the ions. However, the fragmentation spectra produced by PSD are often relatively weak and difficult to interpret. Other prior art MALDI-TOF mass spectrometers include a collision cell that causes some of the ions to undergo high energy collisions with neutral gas molecules to enhance the production of low mass fragment ions and to produce some additional fragmentation. However, these prior art mass spectrometers are not useful for every application.

Other prior art techniques, such as ion traps and Fourier-transform ion-cyclotron-resonance mass spectrometry (FT-ICR-MS), allow multiple steps of fragmentation of primary ions to be observed. These techniques provide a more detailed picture of the fragmentation and in some cases may allow more structural information to be obtained. However, these devices are limited to low energy collisional processes that do not provide some of the specificity provided by high energy collisional dissociation.

Still other prior art mass spectrometers use ESI-TOF that produce fragmentation by causing energetic collisions to occur in the interface between the atmospheric pressure electrospray and the evacuated mass spectrometer. However, these prior art mass spectrometers have no means for selecting a particular primary ion.

There are several prior art tandem mass spectrometers that are generally referred to as MS-MS instruments. MS-MS instruments use mass spectrometer techniques for selecting a primary ion and/or detecting and analyzing fragment ions. The most common form of tandem mass spectrometry is the triple quadrupole mass spectrometer. The first quadrupole selects the primary ion. The second quadrupole is typically maintained at a sufficiently high pressure and voltage so that multiple low energy collisions occur causing some of the ions to fragment. The third quadrupole is scanned to analyze the fragment ion spectrum. The resulting spectra are typically easy to interpret and numerous analysis techniques have been developed. For example, techniques have been developed for determining the amino acid sequence of a peptide from such spectra.

Another prior art tandem mass spectrometer uses two quadrupole mass filters and a TOF mass spectrometer. The first quadrupole selects the primary ion. The second quadrupole is maintained at a sufficiently high pressure and voltage so that multiple low energy collisions occur causing some of the ions to fragment. The TOF mass spectrometer detects and analyzes the fragment ion spectrum.

U.S. Pat. No. 5,202,563 describes a tandem time-of-flight mass spectrometer that includes a grounded vacuum housing, two reflecting-type mass analyzers coupled via a fragmentation chamber, and flight channels electrically floated with respect to the grounded vacuum housing. These mass spectrometers are generally limited to analyzing relatively small molecules and do not provide the sensitivity and resolution required for biological applications, such as sequencing of peptides or oligonucleotides.

For peptide sequencing and structure determination by tandem mass spectrometry, both mass analyzers must have adequate mass resolution and good ion transmission over the mass range of interest. MS-MS systems are typically used for peptide sequencing above a molecular weight of 1000. These systems may include two double-focusing magnetic deflection mass spectrometers having high mass range. Although these instruments provide high mass range and mass accuracy, they are limited in sensitivity, compared to time-of-flight mass spectrometers, and are not readily adaptable for use with modern ionization techniques, such as MALDI and electrospray. These instruments are also very complex and expensive.

Another prior art tandem mass spectrometer that uses time-of-flight mass spectrometer techniques includes two linear time-of-flight mass analyzers that use surface-induced dissociation (SID). One such mass spectrometer includes an ion mirror.

U.S. Pat. No. 5,206,508 describes a tandem mass spectrometer that uses either linear or reflecting analyzers, which are capable of obtaining tandem mass spectra for each parent ion without requiring the separation of parent ions of differing mass from each other.

Tandem mass spectrometers (MS-MS) employing time-of-flight can provide structural information. Such a tandem MS-MS instrument is described in U.S. Pat. No. 6,348,688, the entire disclosure of which is incorporated herein by reference. In this MS-MS instrument, a first mass analyzer is used to select a primary ion of interest, for example, a molecular ion of a particular sample. The ion of interest is then fragmented by increasing the internal energy of the ion.

For example, the ion of interest can be fragmented by causing a collision of the ion with a neutral gas molecule. The mass spectrum of the fragment ions is then analyzed by a second mass analyzer. The structure of the primary ion can be determined by interpreting its fragmentation pattern.

SUMMARY OF THE INVENTION

The present invention relates to improving the performance of mass spectrometers. In one embodiment, a mass spectrometer according to the present invention includes a plurality of TOF mass separators operating in series in a TOF mass spectrometer. A mass separator of the present invention can separate and fragment ionic species generated by a previous mass separator, thereby providing increasingly detailed analysis of a chemical sample with each successive stage. One aspect of the mass spectrometer of the present invention is that modes of operation of the stages of mass spectrometric measurement can be selected electrically.

Accordingly, a tandem time-of-flight mass spectrometer (TOF-MS) of the present invention includes a pulsed ion source that generates a plurality of ions. In one embodiment, the pulsed ion source includes an injector that injects ions into a first field-free region, and a pulsed ion accelerator that extracts the plurality ions from the injected ions by accelerating the ions in a direction that is orthogonal to the direction of injection. In another embodiment, the pulsed ion source is a laser desorption/ionization ion source. In one embodiment, the pulsed ion source is a delayed extraction ion source that extracts the ions after a time delay following ionization. In one embodiment, the pulsed ion source is a pneumatically-assisted electrospray, chemical ionization, or ICP ion source.

The tandem TOF-MS of the present invention also includes a first, a second, and a third TOF mass separator positioned along a path of the plurality of ions generated by the pulsed ion source. The first mass separator is positioned to receive the plurality of ions generated by the pulsed ion source. The first mass separator accelerates the plurality of ions generated by the pulsed ion source, separates the plurality of ions according to their mass-to-charge ratio, and selects a first group of ions based on their mass-to-charge ratio from the plurality of ions. The first mass separator also fragments at least a portion of the first group of ions.

The second mass separator is positioned to receive the first group of ions and fragments thereof generated by the first mass separator. The second mass separator accelerates the first group of ions and fragments thereof, separates the first group of ions and fragments thereof according to their mass-to-charge ratio, and selects from the first group of ions and fragments thereof a second group of ions based on their mass-to-charge ratio. The second mass separator also fragments at least a portion of the second group of ions. The first and/or the second mass separator may also include an ion guide, an ion-focusing element, and/or an ion-steering element.

The third mass separator is positioned to receive the second group of ions and fragments thereof generated by the second mass separator. The third mass separator accelerates the second group of ions and fragments thereof and separates the second group of ions and fragments thereof according to their mass-to-charge ratio. In one embodiment, the third mass separator accelerates the second group of ions and fragments thereof using pulsed acceleration.

The tandem TOF-MS also includes an ion detector positioned to receive the second group of ions and fragments thereof. In one embodiment, the tandem TOF MS also includes an ion reflector positioned in a field-free region. The ion reflector corrects the energy of at least one of the first or second group of ions and fragments thereof before they reach the ion detector. In one embodiment, the tandem TOF-MS may also include a processor that determines the mass-to-charge ratio of ions detected by the ion detector. In one embodiment, the processor includes data processing equipment such as an embedded microprocessor or a stand-alone computer.

A tandem TOF-MS of the present invention can be configured in a variety of ways. In one embodiment, the second TOF mass separator accelerates the first group of ions and fragments thereof with a negative acceleration. Negative acceleration is also called deceleration. In one embodiment, the first TOF mass separator includes in a field-free region an ion selector that selects ions having a mass-to-charge ratio that is substantially within a first predetermined range.

In one embodiment, the second TOF mass separator includes a field-free region and an ion selector that selects ions having a mass-to-charge ratio that is substantially within a second predetermined range. In one embodiment at least one of the first and the second TOF mass separator includes a timed-ion-selector that selects fragmented ions.

In one embodiment, at least one of the first and the second mass separator includes an ion fragmentor. Numerous types of ion fragmentors are known in the art. For example, in one embodiment, the ion fragmentor includes a collision cell in which ions are fragmented by causing them to collide with neutral gas molecules. In another embodiment, the ion fragmentor includes a photodissociation cell that fragments ions by irradiating them with a beam of photons. In yet another embodiment, the ion fragmentor includes a surface dissociation fragmentor that fragments ions by colliding them with a solid or a liquid surface.

The present invention also features a method for high-resolution TOF mass spectrometry of fragmented ions that provides increased structural information. The method includes generating a pulse of ions from a sample of interest. In one embodiment, the pulse of ions is generated by using a method including one of electrospray, pneumatically-assisted electrospray, chemical ionizing, MALDI, and ICP.

Precursor ions are then selected from the pulse of ions during a time interval to form selected precursor ions, where the selected precursor ions have predetermined mass-to-charge ratios. In one embodiment, the precursor ions are selected by transmitting the selected precursor ions through a timed ion selector and by substantially blocking all other ions. The selected precursor ions are then fragmented. In one embodiment, the selected precursor ions are fragmented by colliding the selected precursor ions with neutral gas molecules, thereby exciting the selected precursor ions. In one embodiment, the selected precursor ions are fragmented by passing the selected precursor ions through a nearly field-free region, thereby allowing the selected precursor ions to substantially complete fragmentation.

Primary ion fragments are then selected from the fragmented selected precursor ions during a time interval to form selected primary ion fragments. In one embodiment, the kinetic energy of the selected primary ion fragments is adjusted. The selected primary ion fragments are then fragmented to form secondary ion fragments. In one embodiment, the selected primary ion fragments are passed through a nearly field-free region, thereby allowing the selected primary ion fragments to substantially complete fragmentation.

The secondary ion fragments are then separated in time from the selected primary ion fragments. In one embodiment, the secondary ion fragments are focused. At least one of the selected primary and the secondary ion fragments are detected as a function of time to produce a mass spectrum.

The method may also include adjusting the kinetic energy of the selected primary ion fragments. In one embodiment, the energy of the primary ion fragments is adjusted to compensate for changes in the mode of operation of a tandem TOF MS according to the present invention. In one embodiment, the method includes focusing the secondary ion fragments.

BRIEF DESCRIPTION OF THE DRAWINGS

This invention is described with particularity in the appended claims. The above and further aspects of this invention may be better understood by referring to the following description in conjunction with the accompanying drawings, in which like numerals indicate like structural elements and features in various figures. The drawings are not necessarily to scale, emphasis instead being placed upon illustrating the principles of the invention.

DETAILED DESCRIPTION

A typical time of flight mass spectrometer comprises a pulsed source of ions, a time-of-flight mass separator, and a detector. The typical time-of-flight mass separator also includes an ion accelerator, a field-free drift space, and can include an ion fragmentor, and a timed ion selector. The kinetic energy gained by the ions in the ion accelerator is equal to the product of the ion charge multiplied by the potential difference in the ion accelerator. Thus the kinetic energy gain is independent of the ion mass.

The kinetic energy is related to the ion velocity through the well-known relationship that kinetic energy is equal to one-half of the mass multiplied by the square of the velocity. If the kinetic energy before acceleration is small, or independent of mass, then the velocity of ions in the field-free drift space is proportional to the square root of the mass-to-charge ratio of the ions. Ions of lower mass travel faster than ions of higher mass; thus, the lower mass ions arrive at any selected point in the field-free region at an earlier time than higher mass ions. In a time-of-flight mass spectrometer, an ion detector is placed in the path of the ions. When an ion strikes the detector, it produces an electrical pulse. The time interval between production of a pulse of ions and the electrical pulse produced by the detector in response to an ion is recorded by the time-off-light mass spectrometer, and this time interval may be calibrated to provide a measurement of the mass-to-charge ratio of the ion.

Some of the ions present in the field-free drift space can fragment to produce an ion of lower mass and a neutral fragment. Fragmentation can occur spontaneously as the result of excess internal energy imparted to the ion during its formation in the ion source, or it can occur as the result of passing the ions through an ion fragmentor positioned in the mass separator. The energy with which these fragments separate may be very small compared to the kinetic energy of the original ion. Thus the fragment ion continues to move through the field-free drift space with substantially the same velocity as the unfragmented ion, and both arrive at the detector at substantially the same time. The fragment ion has a smaller kinetic energy than the unfragmented ion by an amount corresponding to the kinetic energy of the neutral fragment.

The mass separator can include a timed ion selector. The timed ion selector is energized to transmit ions arriving at the selector within a selected time interval after formation of the pulse of ions, and to reject ions arriving at all other times. Thus, only ions within the mass-to-charge ratio range that arrive at the timed ion selector within the selected time interval, and fragments thereof, are transmitted and all others are rejected.

Figure 1:
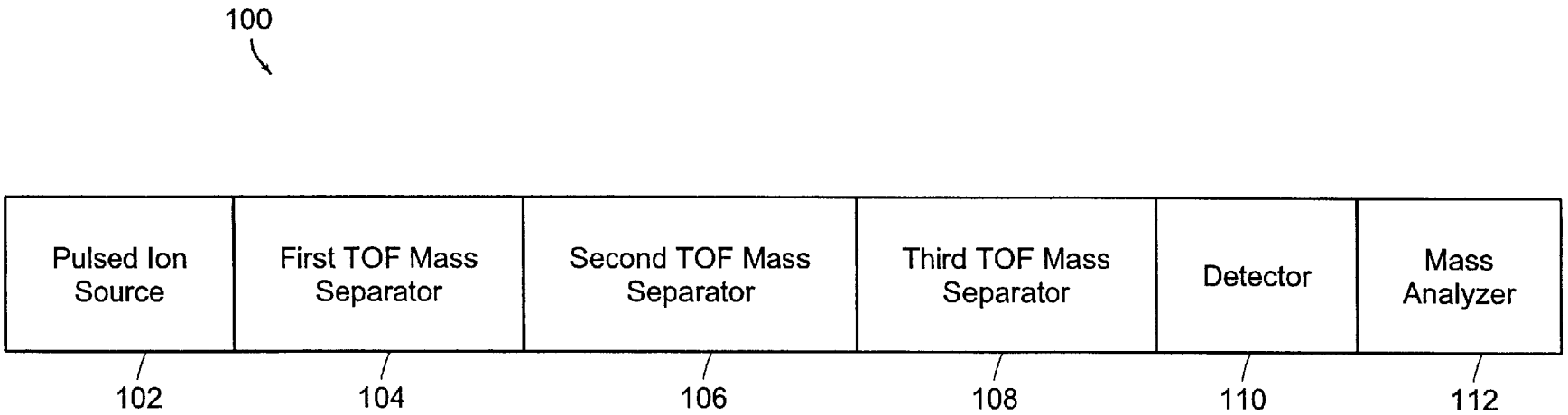
FIG. 1 illustrates a general block diagram of a tandem TOF mass spectrometer according to the present invention.

Referring more particularly to the figures, FIG. 1 illustrates a general block diagram of a tandem TOF mass spectrometer 100 according to the present invention. The TOF mass spectrometer 100 includes a pulsed ion source 102 that generates a packet of ions in a brief period of time. The packet of ions includes a plurality of ions derived from a chemical sample that is introduced into the TOF mass spectrometer 100 for analysis.

The chemical sample can be any chemical sample from which the pulsed ion source 102 can generate the packet of ions. For example, the chemical sample can be a biological sample that includes a mixture of peptides produced by enzymatic digestion of proteins. The chemical sample can also be an inorganic or organic chemical sample, or a mixture of organic and inorganic compounds.

The pulsed ion source 102 can be any type of pulsed ion source, and can employ any ionization technique. For example, the pulsed ion source 102 can include ESI, chemical ionization, electron impact, inductively-coupled plasma (ICP), or MALDI. In one embodiment, the pulsed ion source 102 is a MALDI source having delayed ion extraction.

In another embodiment, the pulsed ion source 102 includes an ESI source that injects ions into a field-free region, and a pulsed ion accelerator that extracts the ions in a direction that is orthogonal to a direction of injection. By field-free region we mean a volume of space in which substantially no electric or magnetic field is applied for the purpose of accelerating or decelerating ions along the flight path. Deceleration is also referred to as negative acceleration. A field-free region can include ion focusing lenses, ion guides, and beam steering electrodes.

A tandem TOF mass spectrometer according to the present invention includes a plurality of time-of-flight (TOF) mass separators that are positioned along the flight path of the ions generated by the pulsed ion source 102. Each of the plurality of TOF mass separators provides additional capability to analyze a chemical sample by further selecting and fragmenting ions from the packet of ions. The TOF mass spectrometer 100 shown in FIG. 1 includes a first TOF mass separator 104, a second TOF mass separator 106, and a third TOF mass separator 108.

The first TOF mass separator 104 is positioned along the flight path of the ions to receive the plurality of ions generated by the pulsed ion source 102. The first TOF mass separator 104 accelerates at least a portion of the plurality of ions. Additionally, the first TOF mass separator 104 separates the plurality of ions and selects a first group of ions and fragments thereof.

The second TOF mass separator 106 is positioned to receive the first group of ions and fragments thereof leaving the first TOF mass separator 106. The second TOF mass separator 106 accelerates at least a portion of the first group of ions and fragments thereof. Additionally, the second TOF mass separator 106 selects a second group of ions and fragments thereof.

The third TOF mass separator 108 is positioned to receive the second group of ions and fragments thereof leaving the second TOF mass separator 106. The third TOF mass separator 108 accelerates at least a portion of the second group of ions and fragments thereof. Additionally, the third TOF mass separator 108 may select a third group of ions and fragments thereof. An ion detector 110 for detecting the ions separated according to their mass-to-charge ratio is positioned to receive at least one of the second or third group of ions and fragments thereof leaving the third TOF mass separator 108.

In one embodiment, a mass analyzer 112 receives electrical signals from the ion detector 110. The mass analyzer 112 generates mass analysis based, at least in part, on the electrical signals received from the ion detector 110. In another embodiment (not shown), the third TOF mass selector 108, together with the ion detector 110, comprise a mass analyzer.

In one embodiment, the mass analyzer 112 includes a field-free drift region (not shown) and an ion reflector (not shown) that is positioned along the flight path of the ions before the ion detector 110. Ion reflectors are also referred to as ion mirrors or reflectrons.

In operation, a packet of ions is generated from the pulsed ion source 102. The first TOF mass separator 104 receives the packet of ions from the pulsed ion source 102, accelerates the packet of ions, and selects from the packet of ions a first group of ions having a predetermined mass-to-charge ratio range. The first TOF mass separator 104 fragments a fraction of the ions in the first group of ions, and transmits the first group of ions and fragments thereof into the second TOF mass separator 106 positioned along the flight path.

The second TOF mass separator 106 receives the first group of ions and fragments thereof from the first TOF mass separator 104 and accelerates the first group of ions and fragment thereof. The second TOF mass separator 106 separates the first group of ions and fragments thereof according to their mass-to-charge ratio and selects from the first group of ions and fragments thereof a second group of ions having a predetermined mass-to-charge ratio range. The second TOF mass separator 106 fragments a fraction of the ions in the second group of ions, and transmits the second group of ions and fragments thereof into the third TOF mass separator 108.

The third TOF mass separator 108 receives the second group of ions and fragments thereof from the second TOF mass separator 106 and accelerates the second group of ions and fragment thereof. The third TOF mass separator 108 separates the second group of ions and fragments thereof according to their mass-to-charge ratio and selects from the second group of ions and fragments thereof a third group of ions having a predetermined mass-to-charge ratio range.

The third TOF mass separator 108 fragments a fraction of the ions in the third group of ions, separates the third group of ions and fragments thereof according to their mass-to-charge ratio, and transmits the third group of ions and fragments thereof to the ion detector 110. In one embodiment, the separation of the third group of ions and fragments thereof occurs in an ion reflector (not shown) and the voltage applied to the ion reflector may be programmed to focus at least a portion of the fragment ions at the ion detector 110.

The operations of accelerating, separating, selecting, and fragmenting ions in the first 104, the second 106, and the third TOF mass separators 108 can be controlled electronically to meet specific requirements of a particular mass spectrometric analysis or operating mode of the TOF mass spectrometer 100. In one embodiment, at least one of the selecting, fragmenting, and accelerating in one of the first 104, the second 106, and the third TOF mass separators 108 is deactivated.

In one embodiment of the present invention, the operating mode of the TOF mass spectrometer 100 can be changed by activating or deactivating one of the first 104, the second 106, and the third TOF mass separators 108. In one embodiment, the operating mode of the TOF mass spectrometer 100 can be changed by activating or deactivating an ion selector, an ion fragmentor, or an ion accelerator in one of the first 104, the second 106, and the third TOF mass separators 108.

In one embodiment, the operating mode of the TOF mass spectrometer 100 is changed during an analysis of a chemical sample. In one embodiment, different operating modes are used to provide complementary analytical information about the chemical sample. In one embodiment, an operating mode of the TOF mass spectrometer 100 is changed automatically under computer control.

Figure 2:
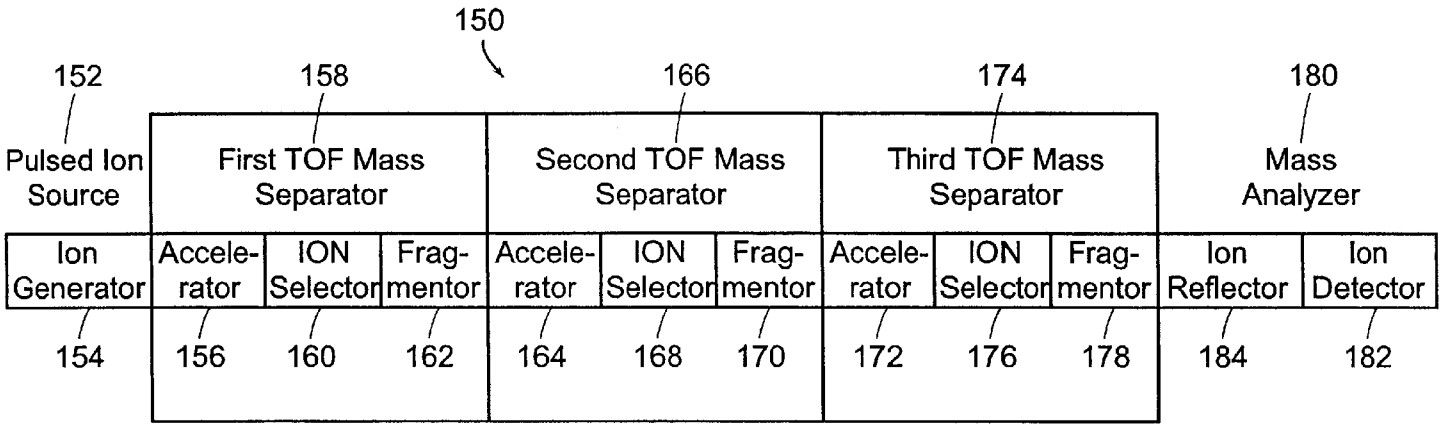
FIG. 2 illustrates a more detailed block diagram of a tandem TOF mass spectrometer according to the present invention.

FIG. 2 illustrates a block diagram of one embodiment of a tandem TOF mass spectrometer 150 of the present invention. The tandem TOF mass spectrometer 150 includes a pulsed ion source 152 having an ion generator 154 that generates a packet of ions. The ion generator 154 can be any type of ion generator. For example, the ion generator 154 can use MALDI or ESI to generate the packet of ions.

The packet of ions from the pulsed ion source 152 is transmitted to a first TOF mass separator 158. The first TOF mass separator 158 includes a first ion accelerator 156 that can be any type of ion accelerator. In one embodiment, the first ion accelerator 156 is a pulsed ion accelerator. A pulsed ion accelerator is an ion accelerator in which a time-dependent electric field accelerates ions in a controlled manner along a flight path. In one embodiment, the first ion accelerator 156 extracts the packet of ions from the ion generator at a predetermined delay time after the packet of ions is generated. The first ion accelerator 156 accelerates the packet of ions along the flight path within the first TOF mass separator 158.

A first ion selector 160 receives the ions accelerated by the first ion accelerator 156. The first ion selector 160 selects ions substantially within a first predetermined mass-to-charge ratio range from the packet of ions and rejects substantially all other ions. The first ion selector 160 can be any type of ion selector. In one embodiment, the first ion selector 160 selects ions (a first group of ions) from the packet of ions by transmitting ions having substantially the predetermined mass-to-charge ratio range and by blocking substantially all other ions.

In one embodiment, the first ion selector 160 includes a drift tube and a timed ion deflector. A drift tube is a field-free region in which previously accelerated ions accumulate spatial separation along the flight path according to differing mass-to-charge ratios. In some applications and operating modes, the first ion selector 160 is deactivated, and no ion selection takes place in the first TOF mass separator 158.

A first ion fragmentor 162 is positioned in a field-free region along the flight path of the first group of ions following the first ion selector 160. In one embodiment, the first ion fragmentor 162 and the first ion selector 160 are positioned in the same field-free region. The first ion fragmentor 162 fragments a fraction of the first group of ions.

The first ion fragmentor 162 can be any type of ion fragmentor. For example, the first ion fragmentor 162 can be a collision cell that causes the packet of ions to collide with neutral gas molecules, thereby causing ions in the packet of ions to energize sufficiently to fragment into ionic and neutral fragments. The first ion fragmentor 162 can also be a photodissociation cell wherein ions are irradiated with a beam of photons. In addition, the first ion fragmentor 162 can be a surface dissociation ion fragmentor that causes ions to collide with a solid or liquid surface. In some applications and operating modes, the first ion fragmentor 162 is deactivated, and ion fragmentation takes place in the first TOF mass separator 158 only if a portion of the plurality of ions fragments as the result of excitation in the ion source.

A second TOF mass separator 166 is positioned along the flight path of the first group of ions and fragments thereof following the first TOF mass separator 158. The second TOF mass separator 166 includes a second ion accelerator 164. The second ion accelerator 164 can be any type of ion accelerator. In some applications and in some operating modes, the second ion accelerator 164 is deactivated, and no ion acceleration takes place in the second TOF mass separator 166.

In one embodiment, the second ion accelerator 164 is a pulsed ion accelerator that includes a fragment energy correction device that improves the mass resolution of the TOF mass spectrometer 150. For example, the second ion accelerator 164 can include a fragment energy correction device that improves the resolution of the TOF mass spectrometer 150 by applying a time varying accelerating field that increases the energy of fragment ions relative to the energy of intact precursor ions, to compensate for energy lost in a fragmentation process.

The second ion accelerator 164 accelerates the first group of ions and fragments thereof in the second TOF mass separator 166 that is positioned along the flight path. The second TOF mass separator 166 includes a second ion selector 168. The second ion selector 168 can be any type of ion selector. The second ion selector 168 can be identical to the first ion selector 160 or can be a different type of ion selector. The second ion selector 168 selects ions substantially within a second predetermined mass-to-charge ratio range (a second group of ions) from the first group of ions and fragments thereof and rejects substantially all other ions. In some applications and in some operating modes, the second ion selector 168 is deactivated, and no ion selection takes place in the second TOF mass separator 166.

A second ion fragmentor 170 is positioned along the flight path following or preceding the second ion selector 168. The second ion fragmentor 170 fragments a fraction of the second group of ions. The second ion fragmentor 170 can be any type of ion fragmentor. The second ion fragmentor 170 can be identical to the first ion fragmentor 162 or can be a different type of ion fragmentor. In some applications and operating modes, the second ion fragmentor 170 is deactivated, and ion fragmentation takes place in the second TOF mass separator 166 only if a portion of the first group of ions fragments as the result of excitation in at least one of the ion source or the first ion fragmentor 162.

A third TOF mass separator 174 is positioned along the flight path of the second group of ions and fragments thereof following the second ion fragmentor 170. The third TOF mass separator 174 includes a third ion accelerator 172. The third ion accelerator 172 can be any type of ion accelerator. The third ion accelerator 172 can-be identical to the second ion accelerator 164 or can be a different type of ion accelerator. The third ion accelerator 172 accelerates the second group of ions and fragments thereof in the third TOF mass separator 174 that is positioned along the flight path. In some applications and operating modes, the third ion accelerator 172 is deactivated, and no ion acceleration takes place in the third TOF mass separator 174.

The third TOF mass separator 174 includes a third ion selector 176 that is positioned along the flight path. The third ion selector 176 can be any type of ion selector. The third ion selector 176 can be identical to the first 160 and/or the second ion selector 168 or can be a different type of ion selector. The third ion selector 176 selects ions substantially within a third predetermined mass-to-charge ratio range (a third group of ions) from the second group of ions and fragments thereof and rejects substantially all other ions. In some applications and operating modes, the third ion selector 176 is deactivated, and no ion selection takes place in the third TOF mass separator 174.

A third ion fragmentor 178 is positioned along the flight path following the third ion selector 176. The third ion fragmentor 178 fragments a fraction of the third group of ions. The third ion fragmentor 178 can be any type of ion fragmentor. The third ion fragmentor 178 can be identical to the first 162 and/or the second ion fragmentor 170 or can be a different type of ion fragmentor. In some applications and operating modes, the third ion fragmentor 178 is deactivated, and ion fragmentation takes place in the third TOF mass separator 174 only if a portion of the second group of ions fragments as the result of excitation in at least one of the ion source, the first ion fragmentor 162, or the second ion fragmentor 170.

The third group of ions and fragments thereof travel along the flight path into a mass analyzer 180. The mass analyzer 180 includes an ion detector 182 that is positioned in the flight path of the third group of ions and fragments thereof. The ion detector 182 detects the selected ions and fragments thereof as a function of time.

In one embodiment, the mass analyzer 180 also includes a field-free drift region (not shown) and an ion reflector 184 that are positioned along the flight path before the ion detector 182. The ion reflector 184 generates one or more retarding electrostatic fields. The ion reflector 184 is used to compensate for the effects of the initial kinetic energy distribution of the ions. In one embodiment, the voltage applied to the ion reflector is adjusted so that at least a fraction of the third group of ions and fragments thereof are focused at the ion detector 182.

As the ions penetrate the ion reflector 184 with respect to the electrostatic fields, they are decelerated until the velocity component in the direction of the field becomes zero. Then, the ions reverse direction and are accelerated back through the ion reflector 184. The ions exit the ion reflector 184 with energies that are substantially identical to their incoming energy but with velocities that are in the opposite direction. Ions with larger energies penetrate more deeply and consequently will remain in the ion reflector 184 for a longer time. In a properly designed ion reflector, the potentials are selected to modify the flight paths of the ions such that ions of like mass and charge arrive at the ion detector 182 at the same time regardless of their initial energy.

The TOF mass spectrometer 150 is enclosed in a vacuum housing (not shown). The vacuum housing is in fluid communication with a vacuum pump (not shown). The vacuum pump maintains the background pressure of neutral gas in the vacuum housing sufficiently low so that collisions of ions with neutral gas molecules are unlikely to occur.

The TOF mass spectrometer 150 of the present invention can be used in a plurality of operating modes. For example, the TOF mass spectrometer 150 can be operated in a mass spectrometer (MS) mode. In the MS mode, the first ion fragmentor 162, the second ion fragmentor 170, and the third ion fragmentor 178 are deactivated. One or more of the first ion selector 160, the second ion selector 168, and the third ion selector 176 can be activated to limit the range of ion masses to be transmitted to the mass analyzer 180. For example, it is often advantageous to remove low-mass ions, such as those produced from the matrix material in MALDI, to avoid saturating the ion detector 182.

In the MS mode, the entire region along the flight path between the pulsed ion source 152 and the ion reflector 184 is field-free except for potentials applied to any ion lenses or ion steering elements (not shown) that are used to direct the ions into the flight path. In the MS mode, substantially all of the ions in the packet of ions, within the selected mass range, are transmitted through the first 158, the second 166, and the third TOF mass separators 174 to the mass analyzer 180. The ions in the packet of ions are then reflected by the ion reflector 184 and then detected by the ion detector 182 as a function of time. A time-of-flight mass spectrum produced in this manner can be calibrated to determine the mass-to-charge ratio of the ions that are detected by the ion detector 182.

In one embodiment, a first additional ion detector (not shown) is located within the field-free drift space of the first TOF mass separator 158 along the flight path of the ions. In this embodiment, the first ion selector 160 is adjusted so that, at least a portion of the first group of ions and fragments thereof is received by the first additional detector and the remainder of the ions are received by the second TOF mass separator 166.

In one embodiment a second additional ion detector (not shown) is located within the field-free drift space of the second TOF mass separator 166 along the flight path of the ions. In this embodiment, the second ion selector 168 is adjusted so that, at least a portion of the second group of ions and fragments thereof is received by the second additional detector and the remainder of the ions are received by the third TOF mass separator 174. In other embodiments, additional ion detectors (not shown) are located within the field-free drift space of both the first TOF mass separator 158 and the second TOF mass separator 166 along the flight path of the ions.

The second ion selector 168 selects ions substantially within a second predetermined mass-to-charge ratio range (a second group of ions) from the first group of ions and fragments thereof and rejects substantially all other ions. In some applications and in some operating modes, the second ion selector 168 is deactivated, and no ion selection takes place in the second TOF mass separator 166.

The TOF mass spectrometer 150 can also be operated in a tandem mass spectrometer-mass spectrometer (MS-MS) mode. In the MS-MS mode, ions within a limited mass-to-charge ratio range detected in an MS mode mass spectrum (a first group of ions) are selected and fragmented in one of the first 158, the second 166, or the third TOF mass separators 174. The selection and fragmentation of the first group of ions can be done in any of the three TOF mass separators. A determination of which one of the three TOF mass separators is used to perform the selection and fragmentation of the first group of ions is based on the requirements of a particular mass analysis.

In one embodiment, the second TOF mass separator 166 provides higher resolution than the first 158 or the third TOF mass separator 174. In one embodiment, the resolution of the TOF mass spectrometer 150 limits the selected mass-to-charge ratio range to less than one atomic mass unit for a singly charged ion. In one embodiment, an ion reflector (not shown) is positioned in at least one of the first TOF mass separator 158 and the second TOF mass separator 166 to improve the resolution of the mass selection. In another embodiment, an ion reflector is positioned in each of the TOF mass separators. In this embodiment, the first group of ions and/or the second group of ions can include only a single ionic specie. One atomic mass unit resolution for a singly charged ion is also referred to as unit mass resolution.

In one embodiment, the selection and fragmentation of the first group of ions from the packet of ions is performed in the second TOF mass separator 166. The kinetic energy of the ions after acceleration in the second TOF mass separator 166 is determined by the difference between a voltage applied to the first ion accelerator 156 and a voltage applied to the second ion accelerator 164. When the first group of ions and fragments thereof reach the third ion accelerator 172, the third ion accelerator 172 is activated to accelerate the first group of ions and fragments thereof along the flight path. The first group of ions and fragments thereof travel along the flight path through the third TOF mass separator 174, and is received by the mass analyzer 180 for mass analysis.

In one embodiment, the energy imparted by the third ion accelerator 172 to the first group of ions and fragments thereof is large compared to the energy of the ions in the packet of ions when they arrive at the second ion selector 168. The fragment ions have a lower kinetic energy than their parent ions in the first group of ions, due to the loss of a neutral fragment in the second ion fragmentor 170. However, after acceleration by the third ion accelerator 172, the spread in energy between the fragment ions and their parent ions is sufficiently small that both the fragment ions and the parent ions can be focused simultaneously and detected in the mass analyzer 180. In this embodiment, high mass resolution can be provided over the entire mass range of the fragment ions.

The TOF mass spectrometer 150 can also be operated in a tandem mass spectrometer-mass spectrometer-mass spectrometer (MS-MS-MS) mode. In MS-MS-MS mode, fragment ions within a limited mass-to-charge ratio detected in an MS-MS mass spectrum (a second group of ions) are selected for further fragmentation. The second 166 or the third TOF mass separator 174 can be used to select and fragment the second group of ions.

In one embodiment, if the mass of the selected (singly-charged) ions in the second group of ions is more than approximately one-third of the mass of the ions in the first group of ions, the second TOF mass separator 166 is used for selecting and fragmenting the second group of ions. If the mass of the selected (singly-charged) ions in the second group of ions is less than approximately one-third of the mass of the ions in the first group of ions, the third TOF mass separator 174 is used to perform the selecting and fragmenting of the second group of ions.

In one embodiment, the second TOF mass separator 166 selects and fragments the first group of ions, and the third TOF mass separator 174 selects and fragments the second group of ions. In this embodiment, the ion reflector voltage is adjusted to focus the second group of ions and fragments thereof, which move at substantially a single velocity as they enter the mass analyzer 180.

In another embodiment, the first TOF mass separator 158 selects and fragments the first group of ions, and the second TOF mass separator 166 selects and fragments the second group of ions. In this embodiment, the voltage applied to the pulsed ion source 152 is increased so that the desired fragment ion to be selected as the second group of ions has the desired kinetic energy for fragmentation in the second ion fragmentor 170. For example, if (for singly charged ions) the ratio of a selected fragment mass in the second group of ions to a selected mass in the first group of ions is R, then the voltage at the pulsed ion source 152 is increased by a factor of substantially1/R, compared to that used in MS-MS mode.

When the second group of ions and fragments thereof reach the third ion accelerator 172, the third ion accelerator 172 is activated to accelerate the second group of ions and fragments thereof along the flight path. The second group of ions and fragments thereof travel along the flight path through the third TOF mass separator 174, and is received by the mass analyzer 180 for mass analysis.

The TOF mass spectrometer 150 can also be operated in a tandem mass spectrometer-mass spectrometer-mass spectrometer-mass spectrometer (MS-MS-MS-MS) mode. MS-MS-MS-MS mode requires selecting and fragmenting ions in all three TOF mass separators. A first group of ions is selected and fragmented in the first TOF mass separator 158, a second group of ions is selected and fragmented in the second TOF mass separator 166, and a third group of ions is selected and fragmented in the third TOF mass separator 174.

Figure 3:
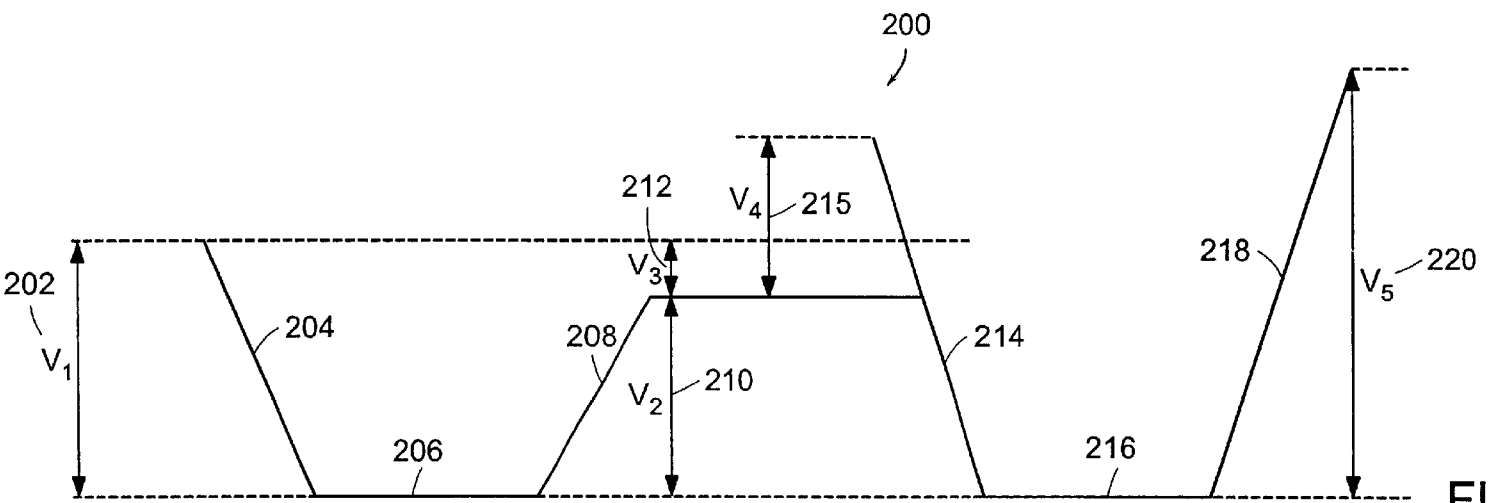
FIG. 3 illustrates a potential diagram associated with the operation of the tandem mass spectrometer 150 of FIG. 2.

FIG. 3 illustrates a potential diagram 200 associated with the operation of the tandem mass spectrometer 150 of FIG. 2. Referring to both FIG. 2 and FIG. 3, the potential diagram 200 is illustrated to show the potential associated with the various sections of the tandem mass spectrometer 150 of FIG. 2. The packet of ions produced by the ion generator 154 has a potential $V_1$ 202. The packet of ions is then exposed to a potential gradient 204 in the first ion accelerator 156, which accelerates the packet of ions.

The packet of ions is transmitted to the first TOF mass separator 158 where they pass through the first ion selector 160 and the ion fragmentor 162 at a constant potential 206. The first ion selector 160 selects a first group of ions and fragments thereof. The first group of ions and fragments thereof is transmitted to the second TOF mass separator 166 where they are exposed to a potential gradient 208 from the second ion accelerator 164. The potential gradient terminates at potential $V_2$ 210.

The energy of the first group of ions is the sum of the initial kinetic energy of the ions produced by the ion generator 154 and the kinetic energy resulting from the potential $V_1$ 202 in the first ion accelerator 156. Thus, the kinetic energy $T_1$ of the first group of ions is $$T_1=zV_1+T_0$$

where $T_0$ is the initial kinetic energy of the ions produced by the ion generator 154, and z is the charge of the ions. If the initial kinetic energy $T_0$ is small or independent of the mass of the ions, then the kinetic energy $T_1$ is substantially independent of the mass of the ions. The velocity of ions of a particular mass $m_p$ is as follows:

$$v=(2T_1/m_p)^{1/2}$$

If these ion fragments to form an ion of mass $m_f$ that is less than mass $m_p$ by an amount $m_n$ that corresponds to the mass of the neutral fragment, and if the kinetic energy accompanying the fragmentation process is small, then the fragment ions continue along the ion path with a velocity v. The kinetic energy of the fragment ions is:

$$T_1(m_f)=T_1R,$$

where $R=m_f/m_p$.

If the excitation of the first ion selector 162 is timed to allow ions within a small increment about a predetermined velocity v to be transmitted, then ions within a predetermined mass range of $m_p$ are transmitted, along with fragments thereof, and all others ions and fragments are rejected.

The potential diagram in FIG. 3 illustrates the ion acceleration caused by the second ion accelerator 164 as a negative acceleration or a deceleration. The kinetic energy $T_2$ of ions traveling without fragmenting through the first TOF mass separator 158 and then through the second accelerator 164, where they are exposed to a deceleration field, can be expressed by the following equation:

$$T_2=T_1-zV_2=zV_3+T_0,$$

where $T_1$ represent the kinetic energy of the ions in the first TOF mass separator 158, $T_0$ represents the initial kinetic energy of the ions generated by the ion generator 154, z represents the charge of the ions and $V_3$ 212 is the potential difference between the potential $V_1$ 202 and the potential $V_2$ 210.

For a fragment ion of mass $m_f$ formed from a precursor ion of mass $m_p$, the kinetic energy after deceleration is as follows:

$$T_2(m_f)=T_1R-zV_2,$$

where R is the ratio of masses. If the kinetic energy of a fragment of mass $m_f$ is less than or equal to zero, then those ion fragments are not transmitted further into the second TOF mass separator 166. The energy of a particular fragment mass $m_f$ can be adjusted to any predetermined value by adjusting the relative magnitudes of the potentials $V_1$ 202 and $V_2$ 210.

The first group of ions and fragments pass through the second ion selector 168 and the second ion fragmentor 170 at a constant potential $V_2$ 210. The velocity of a fragment ion of mass $m_f$ from the first group of ions selected in the first TOF mass separator 158 as it travels through the field-free regions of the second TOF mass separator 166 is:

$$v(m_f)=[2T_2(m_f)/m_f]^{1/2}.$$

If the excitation of the second ion selector 168 is timed to allow ions within a small increment about a predetermined velocity $v(m_f)$ to be transmitted, then a second group of ions comprising ions within a predetermined mass range of $m_f$ are transmitted, along with fragments thereof, and all others are rejected. The transmitted ions are accelerated by the third ion accelerator 172. In one embodiment, this is a pulsed accelerator timed to accelerate the ions by applying an accelerating pulse of amplitude $V_4$ 215 a predetermined time after the selected ions enter the accelerator.

In one embodiment, the total accelerator potential $V_2+V_4$ of gradient 214 is chosen to be much larger than the potential difference $V_1-V_2$. This choice reduces the energy spread of the fragment ions relative to the total kinetic energy of ions in mass analyzer 180 and allows high resolution to be achieved for all of the ions with a single setting of the potential $V_5$ 220 applied to the ion reflector 184.

Ions traveling through the third mass separator 174 can be caused to fragment by the third ion fragmentor 178, and a particular range of masses and fragments thereof may be selected by the third ion selector 176. The selected ions travel within a narrow range of selected velocities, and the fragments thereof have similar velocities, but have differing kinetic energies due to the energy carried by the neutral fragment as discussed herein.

The fragment ions are separated from the precursors by the effect of deceleration and acceleration in the ion reflector 184. Lower energy ions penetrate a shorter distance into the ion reflector 184, and thus arrive at the ion detector 182 earlier than higher energy ions. Thus, the fragments are separated in time from the precursors. The potential $V_5$ 220 of the ion reflector 184 is normally set to focus the precursor ions at the ion detector 182, but if the potential $V_5$ 220 is decreased a selected range or fragment ions may be focused.

The accelerating fields in the first 156, the second 164, and the third accelerator 172, and in the reflector 184 are depicted as homogeneous electrostatic fields for simplicity. However, in some embodiments of the present invention, these electrostatic fields are pulsed, non-homogeneous, or segmented into one or more segments of homogenous fields.

The tandem mass spectrometer of the present invention can operate in numerous modes. For example, in the MS-MS mode, the potentials are adjusted as described herein, and the first ion fragmentor 162 is deactivated. Precursor ions can be selected by at least one of the first 160 and the second ion selector 168. The selected ions are then fragmented in the second TOF mass separator 166 by the second fragmentor 170. The resulting fragment spectrum is then separated in the third TOF mass separator 174 and then analyzed by the mass analyzer 180.

For example, in tandem MS-MS-MS operating modes, the potentials are similar to those used for operating in the MS-MS as described herein. However, the difference between the potential the $V_1$ 202 and the potential $V_2$ 210 is adjusted to provide a predetermined kinetic energy for a selected primary fragment ion in the second TOF mass separator 166. In this mode, the first ion selector 160 selects a nominal precursor mass.

The resulting ions are then fragmented by the first ion fragmentor 162 in the field-free region of the first TOF mass separator 158. A predetermined primary fragment ion is then selected by the second ion selector 168. These selected ions are then further fragmented by the second fragmentor 170. The ions are then separated in the third TOF mass separator 174 and analyzed by the mass analyzer 180.

For example, in tandem MS-MS-MS-MS operating modes, the third fragmentor 178 and the third ion selector 176 are activated to select and fragment a predetermined mass from the secondary fragments from the second fragmentor 170.

In one embodiment, the mode of operation of the tandem TOF mass spectrometer 150 of the present invention is changed automatically under computer control during an analysis of a chemical sample. In this embodiment, the mode of operation of a tandem TOF mass spectrometer according to the present invention can be changed to single MS mode, MS-MS mode, MS-MS-MS mode, or MS-MS-MS-MS mode (and of course to higher modes ($MS^n$)).

For example, the mode of operation of the tandem TOF mass spectrometer can be changed to a single MS mode by reducing the potentials $V_2$ 212 and $V_4$ 215 to zero and by deactivating the ion fragmentors 162, 170, and 178. One or more of the ion selectors 160, 168, or 178 can be used to remove unwanted ions from the spectrum. For example, the ion selectors 160, 168, or 178 can be employed to remove ions from the MALDI matrix or other background material that are not related to the sample under analysis.

The present specification includes a description of four stages of mass analysis. However, the invention is not limited in the number of stages that can be employed. Additional stages can be added by including additional TOF mass separators as described herein. Additional stages are required as necessary to provide additional structural information. Also, additional stages can be used to provide additional functionality. Practical devices containing a large number of stages can be constructed.

In one embodiment of the tandem mass spectrometer of the present invention, the spectrometer includes a large number of stages (greater than four stages), and the required mass separation is accomplished by employing positive acceleration only. However, since such systems involve an increase in the ion energy at each stage, it is difficult to achieve high resolution for the fragment spectra within practical limits for the applied voltages. In another embodiment of the tandem mass spectrometer of the present invention, the spectrometer includes a large number of stages of mass analysis (greater than four stages), and the required mass separation is accomplished by alternating between acceleration and deceleration at each successive stage.

There are numerous important applications of tandem mass spectrometry. One application of particular interest is the identification and characterization of proteins in biological samples. Such proteins are usually relatively complex mixtures. There are many applications that desire to identify, quantify, and characterize as many of the proteins present in the sample as possible.

One known technique to identify and characterize proteins is to digest the protein sample using an appropriate proteolytic enzyme, such as trypsin, which cleaves the proteins into peptide fragments. For example, trypsin cleaves at the C-terminal side of arginine and lysine residues in the protein. Using this technique, each protein in a sample may be converted into a number of peptides of lower molecular weight, and the molecular weights of the peptides can be accurately determined by mass spectrometry. MALDI-TOF is a preferred method for accurately determining the molecular weights of peptides produced by protein digestion.

Figure 4:
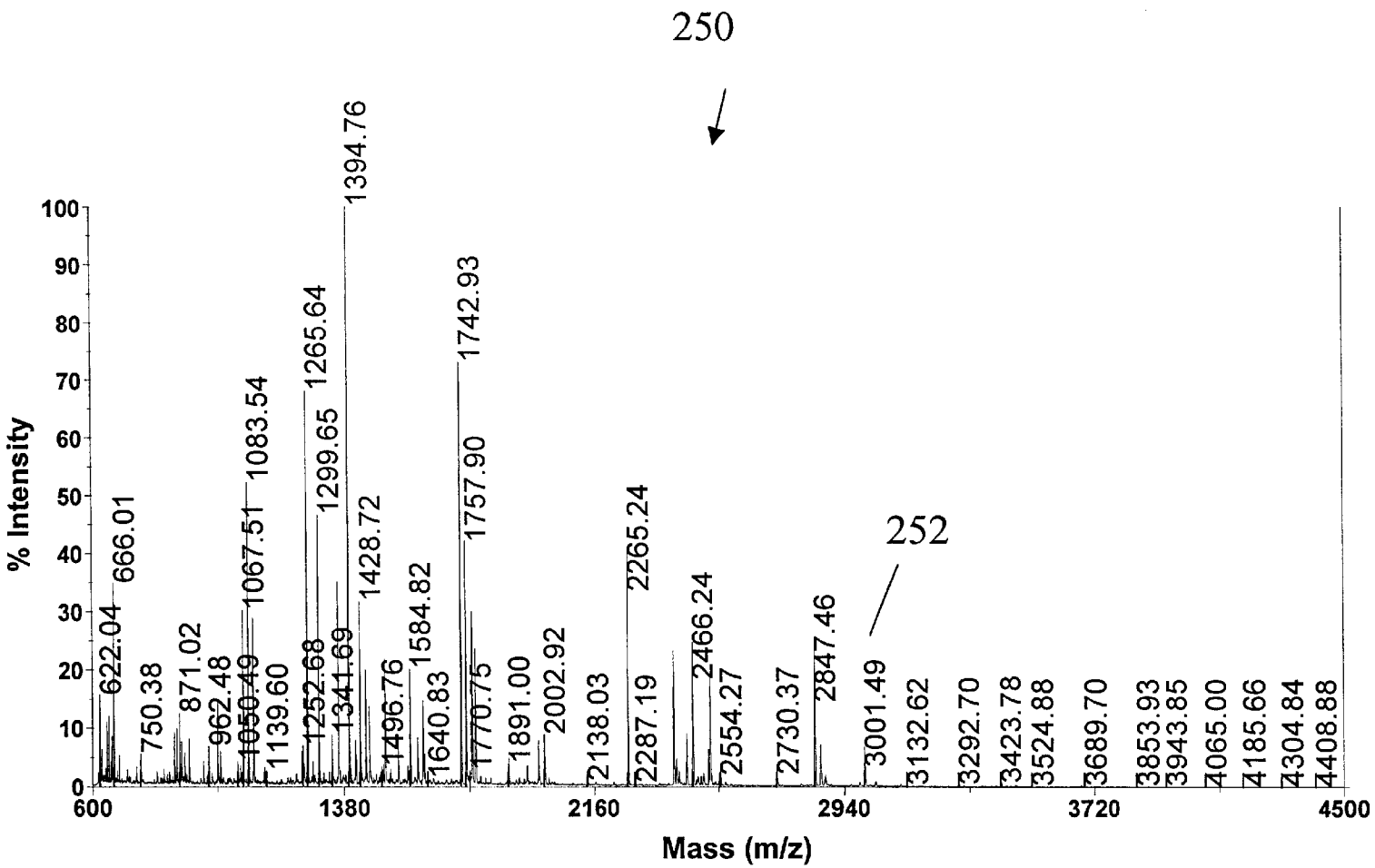
FIG. 4 illustrates an example of a MALDI mass spectrum obtained from a trypsin digest of a protein sample.

FIG. 4 illustrates an example of a MALDI mass spectrum 250 obtained from a trypsin digest of a protein sample. Such a mass spectrum is known in the art as a peptide mass fingerprint. In this example, the molecular weights are determined with an error that is estimated to be less than 10 ppm for all of the peptides detected. The observed masses may be compared with the masses expected from digestion of known proteins in a commercially available database.

If a sufficient number of matches are observed between the observed masses and the expected masses for a particular protein in the database, then it can be concluded with high confidence that the protein is present in the sample. In the example shown in FIG. 4, more than 20 of the observed masses match the masses expected from the protein beta-galactosidase from *E. coli* with an error of less than 10 ppm. Thus, it is apparent from the example shown in FIG. 4 that the beta-galactosidase protein is present in the sample.

While many of the masses observed in FIG. 4 correspond to expected tryptic fragments of beta-galactosidase from *E. coli*, several prominent peaks in the spectrum do not match. These peaks in the spectrum may be due either to the presence of other proteins in the sample, or they may indicate that the structure of the protein identified is not identical with a structure in the database. For example, the protein may include a mutation or it may be a homologous protein from another species. In such cases, peptide mass fingerprinting alone may be insufficient and further tandem mass analysis may be required. One such case is the spectral peak 252 at the nominal m/z 3001 in FIG. 4.

Figure 5:
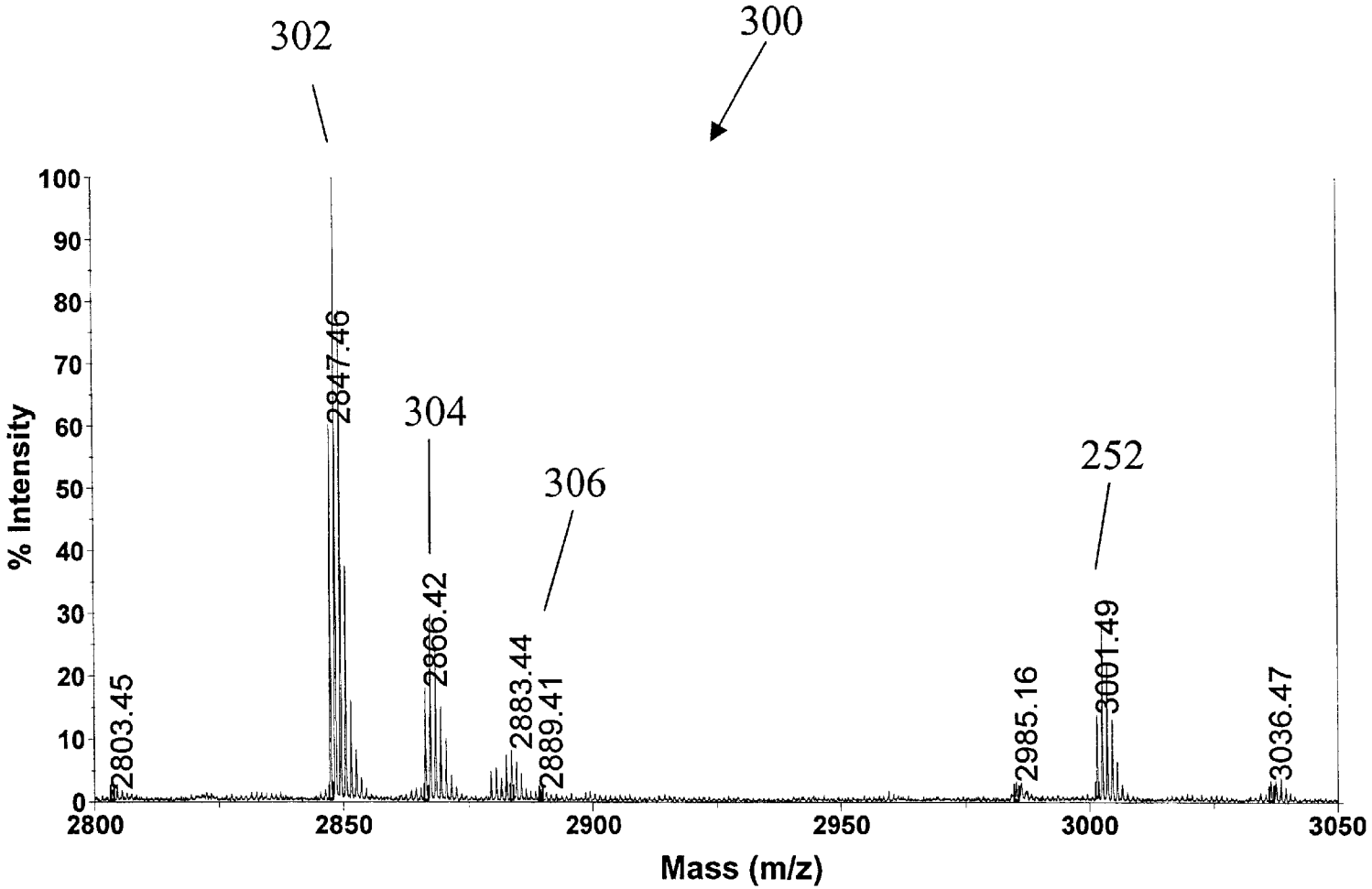
FIG. 5 illustrates an expanded view of the high mass portion of the mass spectrum obtained from a trypsin digest illustrated in FIG. 4.

FIG. 5 illustrates an expanded view of the high mass portion 300 of the spectrum 250 illustrated in FIG. 4. This high mass portion of the spectrum indicates peaks other than the spectral peak 252 at the nominal m/z 3001, such as the spectral peaks at mass 2847 (shown as 302), 2866 (shown as 304), and 2883 (shown as 306). These peaks are identified as tryptic peptide peaks from beta-galactosidase. However, the spectral peak indicated at the nominal m/z 3001 is not identified with any tryptic peptide.

Figure 6A:
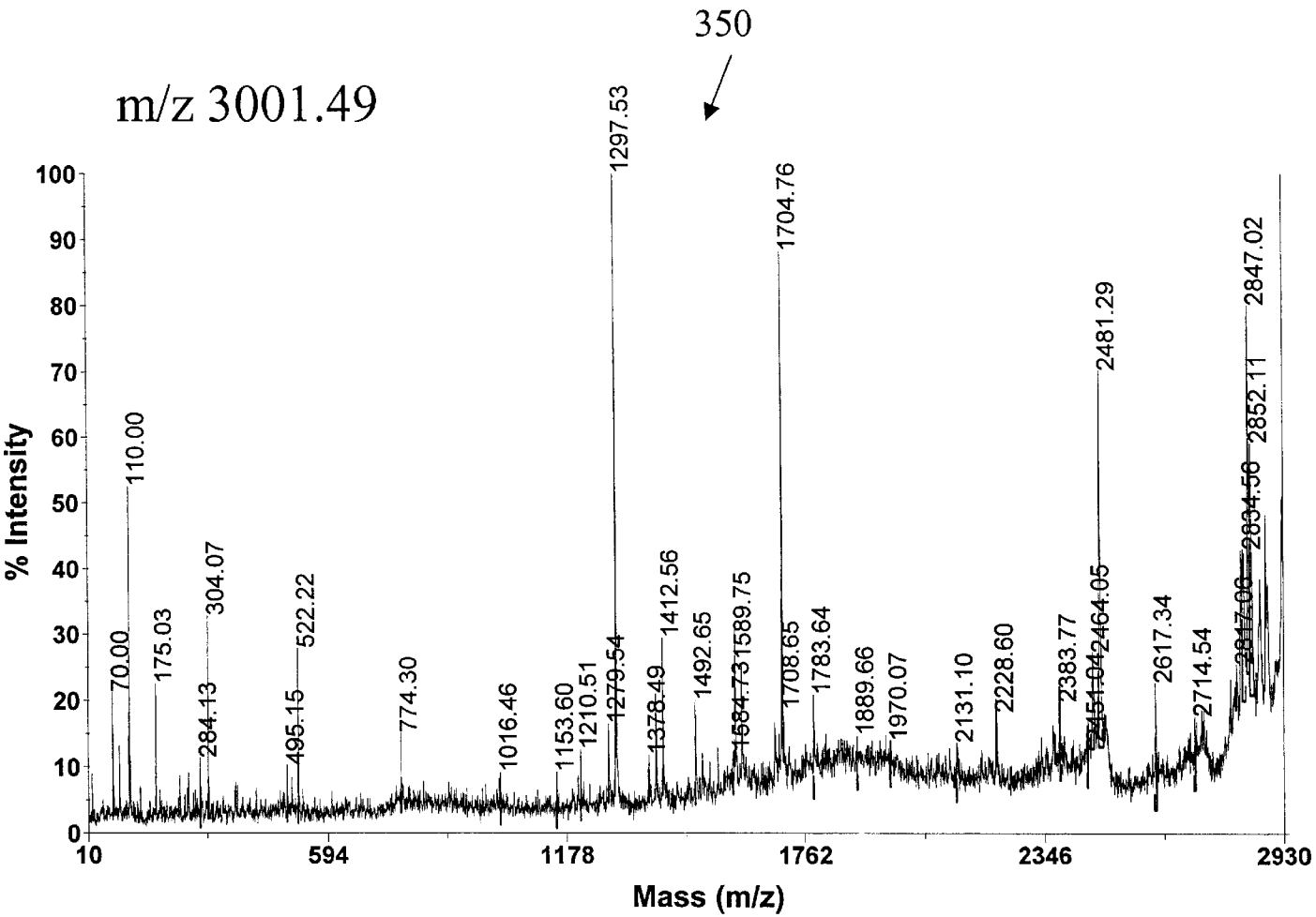
FIG. 6*a* illustrates a MALDI-TOF MS-MS spectrum that was obtained by selecting the m/z 3001 fragment ion from the protein digest and performing MS-MS analysis.

FIG. 6*a* illustrates a MALDI-TOF MS-MS spectrum 350 that was obtained by selecting the nominal m/z 3001 ion from the protein digest and performing MS-MS analysis. The nominal m/z 3001 ion is selected in the first ion separator 158. The selected ion is then fragmented in the second ion separator 166. The fragments are then analyzed in the TOF mass analyzer 180.

The masses observed in the fragment spectrum may be compared with the fragments expected from peptides produced by tryptic digestion of proteins in the database. The rules for peptide fragmentation are well known so that the masses expected from fragmentation of any peptide of given molecular weight and amino acid sequence are predictable.

In the example illustrated in FIG. 6*a*, no peptide with molecular weight within 10 ppm of the measured value was found that would produce a fragment spectrum in agreement with the observed fragment mass spectrum. However, a peptide with mass 14 Daltons higher was predicted as a tryptic fragment. This mass was not observed in the spectrum shown in FIGS. 4 and 5. The low mass portion of the fragment spectrum predicted for the peptide of nominal molecular weight 3015 was in good agreement with that shown in FIG. 6*a*, but several of the higher mass ions, including the molecular ion differed by 14 Daltons.

Figure 6B:
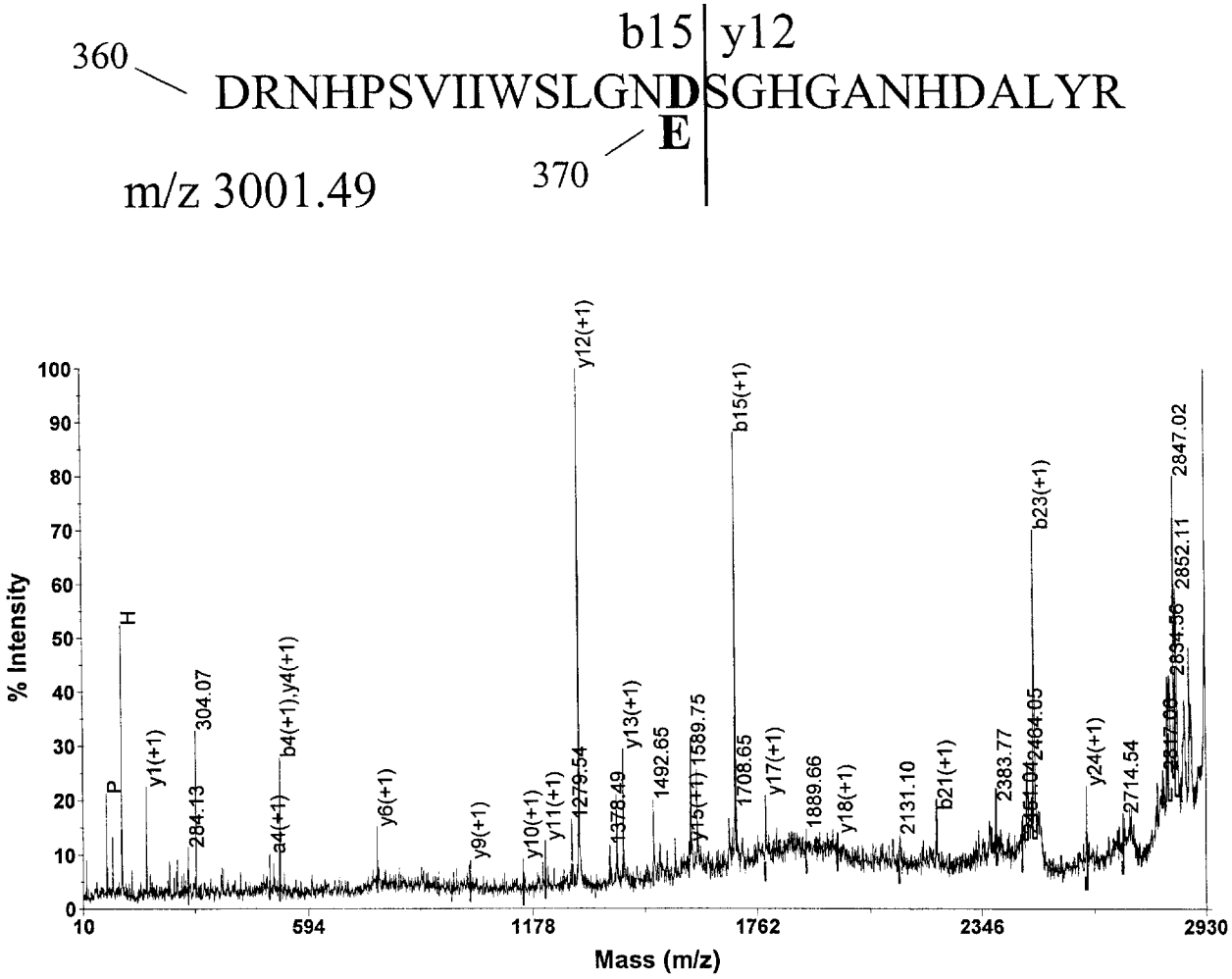
FIG. 6*b* illustrates an interpretation of the MALDI-TOF MS-MS spectrum of FIG. 6*a* that was obtained by selecting the m/z 3001 fragment ion from the protein digest and performing MS-MS analysis.

Interpretation of the MS-MS spectrum obtained for nominal precursor m/z 3001 is illustrated in FIG. 6*b*. Sequence 360 using the standard single letter code for the amino acids corresponds to the sequence retrieved from the commercial database for a peptide of nominal m/z 3015 with glutamic acid (E) at position 370, the $15^{th}$ amino acid from the N-terminus. Sequences are conventionally written with the N-terminus to the left and the C-terminus to the right. In a conventional notation, fragment ions with the charge on the C-terminus are labeled by letters at the end of the alphabet (for example, x,y, z) and fragment ions with charge on the N-terminus are labeled by letters at the front of the alphabet (for example, a, b, c). In particular, ions due to simple cleavage of the peptide bond between amino acids are labeled as y ions if the charge is on the C-terminus and as b ions if the charge is on the N-terminus. Thus, fragmentation of the peptide at the C-terminal side of position 370 yields a y12 ion and a b15 ion. In the spectrum illustrated in FIG. 6*a* a prominent peaks is observed at m/z 1297.53 corresponding to the expected m/z for the y12 ion from sequence 360, but the peak at m/z 1704.76 corresponds to the expected m/z for the b15 ion with aspartic acid (D) rather than glutamic acid (E) at position 370. As shown by the other labeled peaks in FIG. 6*b* the complete fragment spectrum is in good agreement with expected fragmentation of sequence 360 with aspartic acid (D) at position 370, but the higher mass ions differ by 14 mass units from those predicted for sequence 360 with glutamic acid (E) at postion 370.

Comparison of the predicted and the measured spectrum indicate that, in the sample analyzed, the amino acid at position 370 in this peptide is aspartic acid (D) rather than glutamic acid (E) provided in the sequence retrieved from the database as shown in FIG. 6*b*. With this correction, the observed spectrum is in agreement with the predicted spectrum. The resulting spectrum is matched to a mutation of the protein of the beta-galactosidase from *E. coli* in which the indicated glutamic acid (E) has been replaced by aspartic acid (D).

The measured MS-MS spectrum is sufficient to state with confidence that the observed peptide is from beta-galactosidase, and that the indicated amino acid is aspartic rather than glutamic acid. However, the measured MS-MS spectrum may not be sufficient to be certain that there are no other undetected differences between the measured peptide and the sequence in the database.

For example, the intensity of the peaks corresponding to the region between y6 and y12 (see FIG. 6*b*) are rather weak. The measured masses indicate that the amino acid composition of this portion is probably correct. However, it is not possible to state with confidence that the sequence in this region is correct. Also, the peak at the nominal m/z 304 does not correspond to an expected fragment from the indicated sequence. One possibility is that this fragment is the result of a fragmentation process not included in theoretical model, or it may indicate an error in the sequence. These questions may be addressed by extending the tandem mass analysis through the use of additional MS stages.

For example, in MS-MS-MS mode, the nominal m/z 3001 precursor is selected and fragmented in the first mass separator 158, the y12 fragment (m/z 1297.5) is selected and fragmented in the second mass separator 166, and the fragments of y12 are analyzed to provide more definitive data on the sequence of this portion of the peptide. Similarly, the nominal m/z 3001 precursor is selected in the first mass separator 158, it is fragmented in the second mass separator 166, and the fragment at the nominal m/z 304 is selected and fragmented in the third mass separator 174. The fragments of the nominal m/z 304 are separated and analyzed in mass analyzer 180 to provide information on the structure of this ion.

Equivalents

While the invention has been particularly shown and described with reference to specific preferred embodiments, it should be understood by those skilled in the art that various changes in form and detail may be made therein without departing from the spirit and scope of the invention as defined by the appended claims.

What is claimed is:

1. A tandem time-of-flight mass spectrometer comprising:

a) a pulsed ion source that generates a plurality of ions;

b) a first time-of-flight mass separator positioned to receive the plurality of ions generated by the pulsed ion source, the first time-of-flight mass separator accelerating the plurality of ions, fragmenting at least a portion of the accelerated plurality of ions, and selecting a first group of ions and fragments thereof;

c) a second time-of-flight mass separator positioned to receive the first group of ions and fragments thereof, the second time-of-flight mass separator accelerating the first group of ions and fragments thereof, fragmenting at least a portion of the accelerated first group of ions and fragments thereof, and selecting a second group of ions and fragments thereof;

d) a third time-of-flight mass separator positioned to receive the second group of ions and fragments thereof, the third time-of-flight mass separator accelerating the second group of ions and fragments thereof; and e) an ion detector that is positioned to receive the second group of ions and fragments thereof from the third time-of-flight mass separator.

2. The tandem time-of-flight mass spectrometer of claim 1 wherein the pulsed ion source comprises a laser desorption/ionization ion source.

3. The tandem time-of-flight mass spectrometer of claim 1 wherein the pulsed ion source comprises a delayed extraction ion source.

4. The tandem time-of-flight mass spectrometer of claim 1 wherein the pulsed ion source comprises an injector that injects ions into a first field-free region and a pulsed ion accelerator that extracts the ions in a direction that is orthogonal to a direction of injection.

5. The tandem time-of-flight mass spectrometer of claim 1 further comprising a processor that determines the mass-to-charge ratio of ions detected by the ion detector.

6. The tandem time-of-flight mass spectrometer of claim 1 further comprising an ion reflector that is positioned to receive the second group of ions and fragments thereof, the ion reflector correcting energy of the second group of ions and fragments thereof.

7. The tandem time-of-flight mass spectrometer of claim 1 wherein the third time-of-flight mass separator accelerates the second group of ions and fragments thereof with pulsed acceleration.

8. The tandem time-of-flight mass spectrometer of claim 1 wherein the second time-of-flight mass separator accelerates the first group of ions and fragments thereof with a negative acceleration.

9. The tandem time-of-flight mass spectrometer of claim 1 wherein the first time-of-flight mass separator comprises an ion selector that is positioned in a field-free region, the ion selector selecting ions having mass-to-charge ratios that are substantially within a first predetermined mass-to-charge ratio range.

10. The tandem time-of-flight mass spectrometer of claim 1 wherein the second time-of-flight mass separator comprises an ion selector that is positioned in a field free region, the ion selector selecting ions having mass-to-charge ratios that are substantially within a second predetermined mass-to-charge ratio range.

11. The tandem time-of-flight mass spectrometer of claim 1 wherein at least one of the first time-of-flight mass separator and the second time-of-flight mass separator comprises a timed-ion-selector that selects fragmented ions.

12. The tandem time-of-flight mass spectrometer of claim 1 wherein at least one of the first time-of-flight mass separator and the second time-of-flight mass separator comprises an ion fragmentor.

13. The tandem time-of-flight mass spectrometer of claim 12 wherein the ion fragmentor comprises a collision cell that fragments ions by causing ions to collide with neutral gas molecules.

14. The tandem time-of-flight mass spectrometer of claim 12 wherein the ion fragmentor comprises a photodissociation cell that forms fragmented ions by irradiating ions with a beam of photons.

15. The tandem time-of-flight mass spectrometer of claim 12 wherein the ion fragmentor comprises a surface dissociation fragmentor that forms fragmented ions by colliding ions with a solid or liquid surface.

16. The tandem time-of-flight mass spectrometer of claim 1 wherein at least one of the first time-of-flight mass separator and the second time-of-flight mass separator comprises an ion-focusing element.

17. The tandem time-of-flight mass spectrometer of claim 1 wherein at least one of the first time-of-flight mass separator and the second time-of-flight mass separator comprises an ion-steering element.

18. The tandem time-of-flight mass spectrometer of claim 1 wherein at least one of the first time-of-flight mass separator and the second time-of-flight mass separator comprises an ion guide.

19. A method for high resolution time-of-flight mass spectrometry of fragmented ions, the method comprising:

a) generating a pulse of ions from a sample of interest;

b) selecting precursor ions from the pulse of ions during a time interval to form selected precursor ions, the selected precursor ions having predetermined mass-to-charge ratios;

c) fragmenting the selected precursor ions;

d) selecting primary ion fragments from the fragmented selected precursor ions during a time interval to form selected primary ion fragments;

e) fragmenting the selected primary ion fragments to form secondary ion fragments;

f) separating the secondary ion fragments from the selected primary ion fragments in time; and g) detecting at least one of the selected primary and the secondary ion fragments as a function of time to produce a mass spectrum.

20. The method of claim 19 further comprising adjusting kinetic energy of the selected primary ion fragments.

21. The method of claim 19 further comprising focusing the secondary ion fragments.

22. The method of claim 19 wherein the generating the pulse of ions comprises generating the pulse of ions by using one of electrospray, pneumatically-assisted electrospray, chemical ionizing, MALDI, and ICP.

23. The method of claim 19 wherein the fragmenting the selected precursor ions comprises exciting the selected precursor ions by colliding the selected precursor ions with neutral gas molecules.

24. The method of claim 19 wherein the selecting the precursor ions comprises transmitting the selected precursor ions through a timed ion selector and substantially blocking all other ions.

25. The method of claim 19 wherein the selecting the primary ion fragments comprises transmitting the primary ion fragments through a timed ion selector and substantially blocking all other ions.

26. The method of claim 19 further comprising passing the selected precursor ions through a nearly field-free region, thereby allowing the selected precursor ions to substantially complete fragmentation.

27. The method of claim 19 further comprising passing the selected primary ion fragments through a nearly field-free region, thereby allowing the selected primary ion fragments to substantially complete fragmentation.

28. A tandem time-of-flight mass spectrometer comprising:

a) a pulsed ion source that generates a plurality of ions;

b) a first time-of-flight mass separator positioned to receive the plurality of ions generated by the pulsed ion source, the first time-of-flight mass separator accelerating the plurality of ions, fragmenting at least a portion of the accelerated plurality of ions, and selecting a first group of ions and fragments thereof;

c) a second time-of-flight mass separator positioned to receive the first group of ions and fragments thereof, the second time-of-flight mass separator accelerating the first group of ions and fragments thereof, fragmenting at least a portion of the accelerated first group of ions and fragments thereof, and selecting a second group of ions and fragments thereof;

d) a third time-of-flight mass separator positioned to receive the second group of ions and fragments thereof, the third time-of-flight mass separator accelerating the second group of ions and fragments thereof, fragmenting at least a portion of the accelerated second group of ions and fragments thereof, and selecting a third group of ions and fragments thereof;

e) a fourth time-of-flight mass separator positioned to receive the third group of ions and fragments thereof, the fourth time-of-flight mass separator accelerating the third group of ions and fragments thereof; and f) an ion detector that is positioned to receive the third group of ions and fragments thereof from the fourth time-of-flight mass separator.

29. A tandem time-of-flight mass spectrometer comprising:

a) means for generating a pulse of ions from a sample of interest;

b) means for selecting precursor ions from the pulse of ions during a time interval to form selected precursor ions;

c) means for fragmenting the selected precursor ions;

d) means for selecting primary ion fragments from the fragmented selected precursor ions during a time interval to form selected primary ion fragments;

e) means for fragmenting the selected primary ion fragments to form secondary ion fragments;

f) means for separating the secondary ion fragments from the selected primary ion fragments in time; and g) means for detecting at least one of the selected primary and the secondary ion fragments as a function of time to produce a mass spectrum.

* * * * *